US006749909B2

(12) United States Patent
Keeton et al.

(10) Patent No.: US 6,749,909 B2
(45) Date of Patent: Jun. 15, 2004

(54) THERMAL TRANSFER MEDIUM AND METHOD OF MAKING THEREOF

(75) Inventors: Mark Edward Keeton, Dayton, OH (US); Thomas J. Obringer, Vandalia, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/739,761

(22) Filed: Dec. 20, 2000

(65) Prior Publication Data

US 2002/0110670 A1 Aug. 15, 2002

(51) Int. Cl.[7] ..... B41M 5/40

(52) U.S. Cl. ..... 428/32.81; 428/32.61; 428/32.82

(58) Field of Search ..... 428/195, 62.81, 428/62.82, 32.61, 32.8

(56) References Cited

U.S. PATENT DOCUMENTS 4,707,406 A * 11/1987 Inaba et al. ..... 428/336
5,407,724 A 4/1995 Mimura et al. ..... 428/141
5,627,127 A * 5/1997 Hiroi et al. ..... 428/195
5,744,226 A * 4/1998 Olmstead et al. ..... 428/212
5,767,044 A * 6/1998 Bigelow et al. ..... 508/186
5,856,269 A * 1/1999 Hayashi et al. ..... 428/194
5,880,065 A * 3/1999 Hayashi et al. ..... 428/195
6,057,028 A * 5/2000 Tan et al. ..... 428/195
6,077,594 A * 6/2000 Roth ..... 428/195
6,207,268 B1 * 3/2001 Kosaka et al. ..... 428/325
6,254,943 B1 * 7/2001 Osbourne ..... 428/29
6,291,062 B1 * 9/2001 Oshima et al. ..... 156/235
6,309,696 B1 * 10/2001 Mochizuki et al. ..... 427/152
6,468,634 B1 * 10/2002 Miyake et al. ..... 428/195

* cited by examiner

*Primary Examiner*—B. Hamilton Hess
(74) *Attorney, Agent, or Firm*—Millen, White, Zelano & Branigan, P.C.

(57) ABSTRACT

The present invention relates to a thermal transfer medium which transfers images to a receiving substrate. The thermal transfer medium includes a laminate, having a substrate and a coating having protrusions with a length/width ratio of not less than about 3 and at a density of not less than about 20 protrusions/100 micrometer squared, and a functional layer positioned substantially on the coating. This coating may include an oil. Furthermore, the present invention also relates to a method of making the thermal transfer medium.

8 Claims, 1 Drawing Sheet

THERMAL TRANSFER MEDIUM AND METHOD OF MAKING THEREOF

FIELD OF THE INVENTION

The present invention generally relates to thermal transfer printing, and particularly, to a thermal transfer medium and a method of making thereof.

BACKGROUND OF THE INVENTION

Thermal transfer printing is widely used in special applications such as in the printing of machine-readable bar codes on labels or directly on articles to be coded. The thermal transfer process employed by these printing methods provides great flexibility in generating images and allowing for broad variations in style, size and color of the printed images, typically from a single machine with a single thermal print head. Representative documentation in the area of thermal transfer printing includes the following patents:

U.S. Pat. No. 3,663,278, issued to J. H. Blose et al. on May 16, 1972, discloses a thermal transfer medium having a coating composition of cellulosic polymer, thermoplastic resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga, et al. on Jul. 31, 1984, discloses a heat-sensitive magnetic transfer element having a hot melt or a solvent coating.

U.S. Pat. No. 4,523,207, issued to M. W. Lewis et al. on Jun. 11, 1985, discloses a multiple copy thermal record sheet which uses crystal violet lactone and a phenolic resin.

U.S. Pat. No. 4,628,000, issued to S. G. Talvalkar et al. on Dec. 9, 1986, discloses a thermal transfer formulation that includes an adhesive-plasticizer or a sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama, et al., on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mitsubishi on Oct. 18, 1988, discloses a heat transfer sheet comprising a hot melt ink layer on one surface of a film and a filling layer laminated on the ink layer.

U.S. Pat. No. 4,869,941, issued to Ohki on Sep. 26, 1989, discloses an imaged substrate with a protective layer laminated on the imaged surface.

U.S. Pat. No. 4,923,749, issued to Talvalkar on May 8, 1990, discloses a thermal transfer ribbon which comprises two layers, a thermal sensitive layer and a protective layer, both of which are water based.

U.S. Pat. No. 4,975,332, issued to Shini et al. on Dec. 4, 1990, discloses a recording medium for transfer printing comprising a base film, an adhesiveness improving layer, an electrically resistant layer and a heat sensitive transfer ink layer.

U.S. Pat. No. 4,983,446, issued to Taniguchi et al. on Jan. 8, 1991, describes a thermal image transfer recording medium which comprises as a main component, a saturated linear polyester resin.

U.S. Pat. No. 4,988,563, issued to Wehr on Jan. 29, 1991, discloses a thermal transfer ribbon having a thermal sensitive coating and a protective coating. The protective coating is a wax-copolymer mixture which reduces ribbon offset.

U.S. Pat. Nos. 5,128,308 and 5,248,652, issued to Talvalkar, each disclose a thermal transfer ribbon having a reactive dye which generates color when exposed to heat from a thermal transfer printer.

And, U.S. Pat. No. 5,240,781, issued to Obatta et al., discloses an ink ribbon for thermal transfer printers having a thermal transfer layer comprising a wax-like substance as a main component and a thermoplastic adhesive layer having a film forming property.

Generally, thermal transfer ribbons are made by applying the release and functional layers to a substrate in successive stages until the ribbon is substantially complete because the release layer and back coat are generally not stable when in contact with one another.

This is particularly a disadvantage when ribbons are to be completed by the deposition of the functional layer at a site remote, such as a printing station in a warehouse, from the facility used to prepare the laminate. Applying the functional coat remotely can provide flexibility in choosing various functional coats to be applied to the labels depending on the circumstances. In such situations, it is desirable to minimize the number of different layers that must be applied to the substrate to complete a ribbon to reduce the complexity, time, and costs for manufacturing the ribbons.

Consequently, it would be desirable to provide a laminate which need only be coated with the functional coating to complete the ribbon.

SUMMARY OF THE INVENTION

It is a feature of the present invention to provide a thermal transfer medium, such as a thermal transfer ribbon, having a substrate with a coating incorporated thereon. The coating aids the release of a subsequently applied functional layer.

The present invention relates to a thermal transfer medium which transfers images to a receiving substrate or an article. The thermal transfer medium comprises a laminate, having a substrate and a coating positioned on at least one surface thereof. The coating has protrusions with a length/width ratio of not less than about 3 and at a density of not less than about 20 protrusions/100 micrometer squared, and a functional layer positioned substantially on the coating.

The present invention also relates to another class of thermal transfer media which transfer images to a receiving substrate. These thermal transfer media comprise a laminate, having a substrate and a coating comprising a silicone resin and/or an oil/wax positioned substantially on at least one surface of the substrate, and a functional layer positioned substantially on the coating. Thermal transfer media which fall into both classes are also included in this invention.

The present invention further relates to a method of thermally printing an article. The method may include providing a thermal printer having a roller and a thermal printhead, positioning an article proximate to the roller; and positioning a thermal transfer medium between the roller and the printhead.

Additionally, the present invention relates to a thermal transfer medium including a laminate having a substrate and coatings of silicone resin or an oil/wax composition on both sides. At least one coating can have protrusions with a length/width ratio of not less than about 3 and at a density of not less than about 20 protrusions/100 micrometer squared. A thermal transfer medium may be obtained by positioning a functional coat on one of the coatings, which upon heat exposure from the thermal printhead head, at least a portion of the functional coat transfers to the article.

Moreover, the present invention relates to a thermal transfer medium which transfers images to a receiving substrate. The thermal transfer medium includes a laminate. The laminate may further include a substrate, a first coating positioned substantially on one surface of the substrate having protrusions with a length/width ratio of not less than about 3 and at a density of not less than about 20 protrusions/100 micrometer squared, and a second coating positioned substantially on an opposing surface of the substrate from the first coating, wherein the second coating has protrusions with a length/width ratio of not less than about 3 and at a density of not less than about 20 protrusions/100 micrometer squared. Desirably, the compositions of the first and the second coatings are substantially the same.

In addition, the present invention relates to a method for preparing a thermal transfer medium. The method can include providing a substrate having a first side and a second side; coating the first and second sides of the substrate with a composition including a wax, an oil, a silicon polymer, or combination thereof to form a first coating and a second coating; and applying a functional coat to either the first or second coating.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
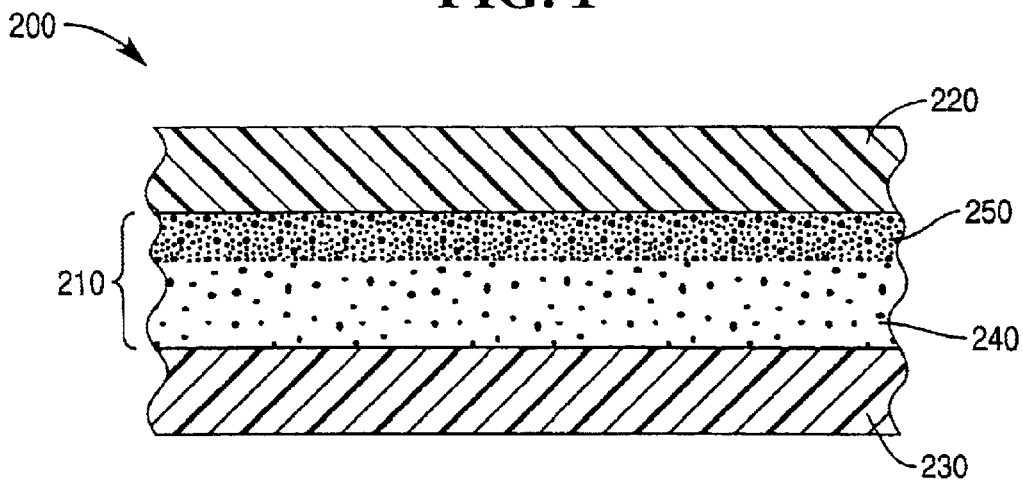
FIG. 1 illustrates a side, cross sectional view of an exemplary thermal transfer medium of the present invention.

As depicted in FIG. 1, an exemplary thermal transfer medium 200, such as a thermal transfer ribbon, can include a laminate 210, a functional layer 220, and a back layer 230. The functional layer 220 and the back layer 230 are applied to opposing sides of the laminate 210.

The laminate 210 comprises a substrate 240 and a coating 250. The coating 250 is applied to the substrate 240 to form the laminate 210, as disclosed in U.S. Pat. No. 5,407,724, hereby incorporated by reference. A commercially available laminate is sold under the trade designation F-531 film by Toray Industries of Tokyo, Japan.

The laminate 210 includes the coating 250 on at least one surface of the substrate, which is preferably a polyester film 240. The coating 250 includes as a major component a wax-based composition, and has protrusions with a length/width ratio of not less than 3 at a density of not less than 20 protrusions/100 $\mu m^2$.

The term "polyester film" used herein includes all polymer films in which ester bonds constitute the main bond in the main chain of the polymer. Among the polyester films, those especially preferred as a film for heat-sensitive image transfer material include polyethylene terephthalate films, polyethylene 2,6-naphthalate films, polyethylene α,β-bis(2-chlorophenoxy)ethane 4,4-dicarboxylate films, polybutylene terephthalate films and the like. Among these, in view of quality and economy, polyethylene terephthalate films are most preferred. Thus, the description hereinbelow will proceed taking the polyethylene terephthalate films (hereinafter referred to as PET films) as the representative of the polyester film used as a base film for a thermal transfer medium 200. The polyethylene terephthalate used herein contains ethylene terephthalate repeating units in the amount of not less than 80 mol %, preferably not less than 90 mol %, still more preferably not less than 95 mol %. Within this range, a part of the acid component and/or the glycol component may be replaced by the third component as follows:

Acid Components isophthalic acid, 2,6-naphthalene dicarboxylic acid, 1,5-naphthalene dicarboxylic acid, 2,7-naphthalene dicarboxylic acid, 4,4-diphenyldicarboxylic acid, 4,4-diphenylsulfondicarboxylic acid, 4,4-diphenylether dicarboxylic acid, p-β-hydroxyethoxy benzoic acid, azipic acid, azelaic acid, sebacic acid, hexahydroterephthalic acid, hexahydroisophthalic acid, ε-oxycaproic acid, trimellitic acid, trimesic acid, pyromellitic acid, α,β-bisphenoxyethane-4,4-dicarboxylic acid, α,β-bis(2-chlorophenoxy)ethane-4,4-dicarboxylic acid, and 5-sodiumsulfoisophthalic acid;

Glycol Components propylene glycol, butylene glycol, hexamethylene glycol, decamethylene glycol, neopentyl glycol, 1,1-cyclohexane dimethanol, 1,4-cyclohexane dimethanol, 2,2-bis(4-β-hydroxyphenyl)propane, bis(4-β-hydroxyphenyl)sulfone, diethylene glycol, triethylene glycol, pentaerythritol, trimethylol propane, polyethylene glycol, and polytetramethylene glycol.

Known additives such as heat stabilizers, anti-oxidants, weathering agents, UV light absorbers, organic lubricants, pigments, dyes, organic and inorganic particles, fillers, anti-static agents, nucleating agents and the like may be added to the PET. By adding inorganic and/or organic particles so as to attain an average surface roughness of the PET film after orientation of preferably 0.03–0.4 $\mu m$, more preferably 0.05–0.2 $\mu m$, the running property may further be promoted.

The intrinsic viscosity (measured in o-chlorophenol at 25° C.) of the PET may preferably be 0.40–1.20 dl/g, more preferably 0.50–0.80 dl/g, still more preferably 0.5–0.75 dl/g.

In view of mechanical strength and dimensional stability, the PET film may preferably be a biaxially oriented film. The biaxially oriented PET film herein means those prepared by stretching a PET sheet at a stretching ratio of about 2.5–5.0 times the original length in the longitudinal and transverse directions, respectively, which exhibit a biaxially oriented pattern in wide angle X-ray analysis.

The thickness of the laminated film may preferably be 0.5–30 $\mu$m, more preferably 1–10 $\mu$m in view of the thermal conductivity and mechanical strength.

It may be desired to coat at least one surface of the PET film with a polyester resin having a glass transition point higher than that of the PET before the stretching and then to stretch the coated PET film. The polyester resin layer can be formed on the side contacting the thermal head 330. A representative example of a polyester having a higher glass transition point than PET is polyethylene 2,6-naphthalate.

The laminate 210 of the present invention has a coating 250, preferably comprising a wax-based composition on at least one surface of the substrate 240. Desirably, the wax-based composition is present in a weight ratio not less than about 50%, preferably not less than about 60% in the coating 250. The wax-based composition includes various commercially available waxes such as petroleum waxes, vegetable waxes, mineral waxes, animal waxes, low molecular polyolefins and the like, although not restricted thereto. Among these, petroleum waxes and vegetable waxes are preferred in view of the anti-sticking property.

Examples of the petroleum waxes include paraffin wax, microcrystalline wax, and oxidized wax. Among these, oxidized wax is especially preferred in view of the formation of the protrusions. Examples of the vegetable waxes include candelilla wax, carnauba wax, haze wax, oricurie wax, sugar cane wax, rosin-modified wax. In the present invention, as the wax-based composition, ester adducts of {rosin or disproportionated rosin or hydrogenated rosin.α,β-substituted ethylene (α substituent: carboxylic group, β substituent: hydrogen, methyl or carboxyl)adduct}.$C_1$–$C_8$ alkyl or $C_1$–$C_8$ alkenyl polyalcohol (number of repeating units: 1–6) are preferred in view of the slipperiness and releasing property. It is more preferred to use the wax just mentioned above together with an oxidized wax. As will be described later, the laminate 210 of the present invention may be prepared by stretching the film in one direction after applying a coating 250 containing the above-described composition so as to form fine and elongated protrusions. In view of the formation of the protrusion, explosion-proofing property and prevention of environmental pollution, waxes which are dissolved, emulsified or suspended in water are especially preferred.

In a preferred mode of the present invention, as the wax, a petroleum wax and a vegetable wax are co-employed. In this case, the mixing ratio of the petroleum wax to the vegetable wax may preferably be about 10/90–90/10, more preferably about 20/80–80/20, still more preferably about 30/70–70/30 based on weight. The vegetable wax is preferably contained in the amount of not less than about 10% by weight and the petroleum wax is preferably contained in the amount of not less than about 10% by weight.

Also provided by this invention are thermal transfer media comprising a laminate and function layer where the laminate comprises a substrate with a coating or silicone resin layer comprising oil/wax and the functional layer is deposited on this coating.

Alternatively, by adding an oily substance to the above-described wax-based composition, the running property in the high pulse width range may be further promoted. The oily substance herein means the oils in the form of liquid or paste at room temperature. The oily substance includes vegetable oils, fats and fatty oils, mineral oils, and synthetic lubricating oils. Examples of the vegetable oils include linseed oil, kaya oil, safflower oil, soybean oil, Chinese tung oil, sesame oil, corn oil, rapeseed oil, rice bran oil, cottonseed oil, olive oil, sasanqua oil, tsubaki oil, castor oil, peanut oil, palm oil, and coconut oil.

Examples of the fats and fatty oils include beef tallow, hog fat, mutton tallow, and cacao butter; and examples of the mineral oils include machine oil, insulation oil, turbine oil, motor oil, gear oil, cutting oil, and liquid paraffin. As the synthetic lubricating oil, those having the characteristics written in Chemical Large Dictionary (published by Kyoritsu Publishing Co.), that is, those having higher viscosity indices, lower flow points, better heat stabilities and oxidation stabilities, and less likely to ignite than petroleum lubricating oils which may be optionally used. Examples of the synthetic lubricating oil include olefin polymer oils, diester oils, polyalkylene glycol oils, and silicone oils. Among these, mineral oils and synthetic lubricating oils which exhibit good running in the high pulse range are preferred. Mixtures of the oily substances may also be employed.

The oily substance may preferably be added to about 100 parts by weight of the wax-based composition in the amount of about 1–100 parts by weight, and more preferably about 3–50 parts by weight.

The coating 250 may also include a silicon polymer with or without the oil and/or wax. Particularly, the coating may include a water-soluble silicone block copolymer comprised of silicone resin blocks of the formula $R'_x(SiR_xZO)_wSi(R''_x)_3$ and blocks of water-soluble polymers selected from the group consisting of polyethylene oxide blocks and polypropylene oxide blocks wherein $R_x$ is H, OH or $C_1$–$C_6$-alkyl, w is 2–300 and Z is $R_x$ or a link to other blocks as hereinafter described for the back layer 230.

The composition may contain various additives in the amount not adversely affecting the effect of the present invention. For example, anti-static agents, heat stabilizers, anti-oxidants, organic and inorganic particles, and pigments may be added. Further, in order to promote the dispersion in water and coating property of the coating liquid, various additives such as dispersing agents, surfactants, antiseptics, and defoaming agents may be added to the coating 250.

The center line average surface roughness of the surface on which the coating layer is formed (Ra1) may preferably be about 0.03–0.4 $\mu$m, more preferably about 0.05–0.2 $\mu$m. The thickness of the coating layer is preferably from 0.005 $\mu$m to Ra1, more preferably from 0.01 $\mu$m to Ra1.

In the laminate 210 of the present invention, the specific protrusions herein below described are formed on the surface of the coating 250. More particularly, the elongated protrusions have a length/width ratio of not less than about 3 on the surface of the coating 250 made of the above-described composition at a density of not less than about 20 protrusions/100 $\mu m^2$.

Preferably, the protrusions have an elongated shape with a length/width ratio of not less than about 3, preferably not less than about 4, still more preferably not less than about 5. The density of the elongated protrusion must be not less than about 20 protrusions/100 $\mu m^2$, preferably not less than about 40 protrusions/100 $\mu m^2$, still more preferably not less than about 60 protrusions/100 $\mu m^2$. The length/width ratio of the protrusions and the density of the elongated protrusions can be calculated by methods as disclosed in U.S. Pat. No. 5,407,724.

The coating 250 may be obtained by applying the composition on the polyester substrate or film 240 before the orientation of the crystals and by stretching the coated polyester substrate 240 after or during drying of the composition, followed by heat treatment so as to complete the orientation of the crystals. More particularly, the polyester film 240 before the orientation of the crystals may be stretched in the longitudinal direction at a stretching ratio of about 2.5–5.0 times the original length. Then corona discharge treatment may be performed on the surface on which the coating 250 is to be applied. Thereafter, the coating 250 can be applied to the surface of the polyester film 240 by using an applicator such as roll coater, gravure coater reverse coater, kiss coater, or bar coater. While drying the composition or after drying the composition, the film 240 may then be stretched in the direction perpendicular to the longitudinal direction at a stretching ratio of about 2.5–5.0 times the original length. As required, a heat treatment at 140–240° C. is performed. By the above-described method, the coating 250 having elongated protrusions may be obtained. To form randomly arranged elongated protrusions, it is important to make a small amount of water remain in the coating 250 before the stretching of the film 240 or to carry out the stretching while moisturizing the film 240, and to allow a small degree of relaxation during the heat treatment.

Although it has been disclosed to apply a single coating 250 to one side of the substrate or film 240, it should be understood that a second coating may be applied to the first coating, or preferably to a side of the substrate 240 opposing the single coated side by generally using the methods as described above. Although independent of the first or single coating 250, this second coating may have a composition as described above for the single coating 250. Consequently, when applied to a substrate 240, this second coating may have the same or different composition than the single coating 250, although it is preferred that the first and second coatings have the same composition. In addition, the functional coat 220 may be applied to either the first or second coating, and optionally, a back layer 230 may be applied to the other coating.

Although the elongated protrusions may be oriented in one direction, in view of the running property, those randomly arranged or crossing each other are preferred. The protrusions on the surface of the coating 250 may preferably be mainly composed of the wax-based composition and the oily substance.

Although the height of the protrusions is not restricted, it is preferably about 0.005–1 $\mu$m, and more preferably 0.01–0.5 $\mu$m.

It may be desirable to incorporate a polymer having sulfonic acid groups or salt thereof in the coating 250 to give anti-static properties to the laminate 210. The polymer having sulfonic acid groups or salt thereof may be blended in the above-described wax-based composition or a layer containing the polymer having sulfonic acid groups or salt thereof may be provided on the surface of the polyester film 240 opposite of the coating 250.

Generally, the functional layer 220 applied to the coating 250 will transfer to paper or other receiving substrate when exposed to the heat and pressure of an operating print head. Such a functional layer 220 can include one or more waxes, binder resins, and sensible materials (pigments).

The functional layer 220 may comprise wax as a main component. Suitable waxes can include those used in conventional thermal transfer ribbons. Examples may include natural waxes such as carnauba wax, rice bran wax, bees wax, lanolin, candelilla wax, motan wax and ceresine wax; petroleum waxes such as paraffin wax and microcrystalline waxes; synthetic hydrocarbon waxes such as low molecular weight polyethylene and Fisher-Tropsch wax; higher fatty acids such as lauric acid, myristic acid, palmitic acid, stearic acid and behenic acid; higher aliphatic alcohol such as stearyl alcohol and esters such as sucrose fatty acid esters, sorbitane fatty acid esters and amides. Generally, the wax-like substances have a melting point less than 200° C. and preferably from 40° C. to 130° C. The amount of wax in the functional layer formulation is preferably above 5 wt. % and most preferably ranges from 10 to 85 percent by weight, based on the weight of dry ingredients.

The functional layer 220 also can comprise a binder resin. Generally, suitable binder resins are those conventionally used in thermal transfer mediums or ribbons. These can include thermoplastic resins and reactive resins such as epoxy resins.

Suitable thermoplastic binder resins may include those described in U.S. Pat. Nos. 5,240,781 and 5,348,348 which have a melting point of less than 300° C., preferably from 100° C. to 225° C. Examples of suitable thermoplastic resins can include polyvinyl chloride, polyvinyl acetate, vinyl chloride-vinyl acetate copolymers, polyethylene, polypropylene, polyacetal, ethylene-vinyl acetate copolymers, ethylene alkyl (meth)acrylate copolymers, ethylene-ethyl acetate copolymers, polystyrene, styrene copolymers, polyamide, ethylcellulose, epoxy resin, xylene resin, ketone resin, petroleum resin, terpene resin, polyurethane resin, polyvinyl butyryl, styrene-butadiene rubber, saturated polyesters, styrene-alkyl (meth)acrylate copolymer, ethylene alkyl (meth)acrylate copolymers. Generally, suitable saturated polyesters are further described in U.S. Pat. No. 4,983,446. Thermoplastic resins are preferably used in an amount of from 2 to 50 wt. % of the functional layer 220.

Generally, suitable reactive binder components include epoxy resins and a polymerization initiator (crosslinker). Suitable epoxy resins can include those that have at least two oxirane groups such as epoxy novolak resins obtained by reacting epichlorohydrin with phenol/formaldehyde condensates or cresol/formaldehyde condensates. Another epoxy resin may be polyglycidyl ether polymers obtained by reaction of epichlorohydrin with a polyhydroxy monomer such as 1,4 butanediol. One exemplary epoxy novolak resin is Epon 164 available from Shell Chemical Company. An exemplary polyglycidyl ether is available from Ciba-Geigy Corporation under the trade name Araldite® GT 7013. The epoxy resins may be employed with a crosslinker which activates upon exposure to the heat from a thermal print head. Crosslinkers may include polyamines with at least two primary or secondary amine groups. Examples being Epicure P101 and Ancamine 2014FG available from Shell Chemical Company and Air Products, respectively. Accelerators such as triglycidylisocyanurate can be used with the crosslinker to accelerate the reaction. When used, the epoxy resins typically can include more than 25 weight percent of the functional coating. Waxes are typically not necessary when reactive epoxy resins form the binder.

The functional layer 220 preferably also contains a sensible material or pigment which is capable of being sensed visually, by heat, by optical means, by magnetic means, by electroconductive means or by photoelectric means. The sensible material is typically a coloring agent, such as a dye or pigment, or magnetic particles. Generally, any coloring agent used in conventional ink ribbons is suitable, including carbon black and a variety of organic and inorganic coloring pigments and dyes, examples of which include phthalocyanine dyes, fluorescent naphthalimide dyes and others such as cadmium, primrose, chrome yellow, ultra marine blue, titanium dioxide, zinc oxide, iron oxide, cobalt oxide, nickel oxide, etc. Examples of sensible materials include those described in U.S. Pat. Nos. 3,663,278 and 4,923,749. Reactive dyes such as leuco dyes are also suitable. In the case of magnetic thermal printing, the functional layer 220 may include a magnetic pigment or particles for use in imaging to enable optical, human or machine reading of the characters. This can provide the advantage of encoding or imaging the substrate with a magnetic signal inducible ink. The sensible material or pigment is typically used in an amount of from about 1 to about 50 parts by weight of the functional layer 220.

The functional layer 220 may have a softening point within the range of about 50° C. to 250° C. which enables transfer at normal print head energies which range from about 100° C. to 250° C. and more typically from about 100° C. to 150° C. The functional layers can be applied by conventional techniques and equipment such as a Meyer Rod or like wire round doctor bar set up on a conventional coating machine to provide the coating weights described above. The coat weight of the functional layer 220 may range from 1.9 to 5.0 g/m$^2$. The functional layer 220 is optionally passed through a dryer at an elevated temperature to ensure drying and adherence to the coating 250 of the laminate 210. The functional layer 220 can be fully transferred onto a receiving substrate 310, such as paper, label or synthetic resin, at a temperature in the range of 75° C. to 200° C.

Preferably, the functional layer 220 may include carnauba wax, candellila wax, polyethylene, wax, polyethylene oxide, carbon black, and/or ferrous oxide. The carbon black and ferrous oxide may be in powder form. These materials can be dissolved in a solvent, such as mineral spirits or water. The functional coat can contain particles ranging from about 1.0 to about 10.0 microns. Desirably, the functional coat is applied in amounts from about 5.0 to about 8.5 g/m$^2$, and more desirably is applied in amount of about 7.7+/−0.3 g/m$^2$.

If a water solvent is used, the functional layer 220 may be applied to the laminate 210, using any suitable means such as spraying. One exemplary coater that can be used is a Multicoater M200 Special (per spec TBP-3177) manufactured by Hirano Tecseed Co., Ltd. of Nara, Japan. During application of the functional layer 220, the laminate 210 can be on a conveyor belt traveling at about 12 meters/minute (40 feet/minute) at a temperature of about 21° C. (70° F.). Generally, the thickness of the functional layer 220 can be controlled by using a Meyer Bar or Gravure application. After application, the functional layer 220 can be dried for about 15 seconds at a temperature of about 93° C. (200° F.).

If a mineral spirits solvent is used, the functional layer 220 may be applied to the laminate 210, using any suitable means such as spraying. One exemplary coater that can be used is a Multicoater M200 Special (per spec TBP-3177) manufactured by Hirano Tecseed Co., Ltd. of Nara, Japan. During application of the functional layer 220, the laminate 210 can be on a conveyor belt traveling at about 12 meters/minute (40 feet/minute) at a temperature of about 60° C. (140° F.). Generally, the thickness of the functional layer 220 can be controlled by using a Meyer Bar or Gravure application. After application, the functional layer 220 can be dried for about 15 seconds at a temperature of about 82° C. (180° F.).

One exemplary functional layer 220 may include the following materials as depicted in Table 1:

TABLE 1

| | Carnauba Wax | Candellila Wax | Polyethylene Oxide | Carbon Black |
|---|---|---|---|---|
| General | (0–80%) | (0–80%) | 5% | 15% |
| Preferred | 60% | 20% | 5% | 15% |
| Optimal | 40% | 40% | 5% | 15% |

The following general, preferred and optimal conditions may be used when utilizing a HIRANO coater using a Meyer Bar application for applying the functional coat 220 to the laminate 210:

TABLE 2

| Hirano Coater Conditions | General | Preferred | Optimal |
|---|---|---|---|
| Line Speed (Feet/Minute) | 0–80 | 40–80 | 40 |
| Dryer 1 (Degrees Fahrenheit) | 160–220 | 180–220 | 200 |
| Dryer 2 (Degrees Fahrenheit) | 160–220 | 180–220 | 200 |
| Fan 1 (Cubic Feet/Minute) | 25–45 | 35–45 | 40 |
| Fan 2 (Cubic Feet/Minute) | 25–45 | 35–45 | 40 |
| Meyer Bar | 6–18 | 10–18 | 15 |
| Coating Thickness (Grams/Square Meter) | 1–5 | 3–5 | 4–5 |

The following general, preferred and optimal conditions may be used when utilizing a HIRANO coater using a Gravure application for applying the functional coat 220 to the laminate 210:

TABLE 3

| | | | |
|---|---|---|---|
| Line Speed (Feet/Minute) | 0–80 | 40–80 | 40 |
| Dryer 1 (Degrees Fahrenheit) | 160–220 | 180–220 | 200 |
| Dryer 2 (Degrees Fahrenheit) | 160–220 | 180–220 | 200 |
| Fan 1 (Cubic Feet/Minute) | 25–45 | 35–45 | 40 |
| Fan 2 (Cubic Feet/Minute) | 25–45 | 35–45 | 40 |
| Gravure Cell Volume (Billionth Cubic Meter) | 8–14 | 10–12 | 11 |
| Coating Thickness (Grams/Square Meter) | 1–5 | 3–5 | 4–5 |

The back layer 230 may include various components, such as those disclosed in U.S. application Ser. Nos. 08/662,734; 09/102,326; and 09/082,249, which are hereby incorporated by reference. The back layer 230 can include a silicone polymer such as a water-soluble silicone block copolymer comprised of silicone resin blocks of the formula $R'_x(SiR_xZO)_wSi(R''_x)_3$ and blocks of water-soluble polymers selected from the group consisting of polyethylene oxide blocks and polypropylene oxide blocks wherein $R_x$ is H, OH or $C_1$–$C_6$-alkyl, w is 2–300 and Z is $R_x$ or a link to other blocks.

Silicone resin block copolymer materials may include those available from Gelest, Inc, Tullytown, Pa. Suitable examples include the silicone block copolymers sold under the trade names DBE-712, DBE-814, DBE-821, DBP-732 and DBP-534 provided by Gelest, Inc. Generally, the silicone block copolymer is applied with deionized water and an antifoaming agent. The use of deionized water may prevent the formation of corrosive agents which attack the print head. Generally, the foaming agent aids the coating process to allow simple coating equipment, such as a Meyer rod, to be used to form thin coatings. Alternative methods for applying the back layer 230 to the substrate 240 of the laminate 210 are suitable. The silicone block copolymer may be applied to the substrate 240 by a back layer 230 coating formulation which employs from 0.5 to 10 wt. % silicone block copolymer, and 0.01 to 0.1 wt. % defoamer with the balance being deionized or distilled water. This back layer 230 coating formulation can be applied with a #0 Meyer rod. Generally, the silicone block copolymer is employed in an amount in the range of about 2 to 10 wt. % of the coating formulation.

The silicone block copolymer preferably comprises silicone resin blocks of the structure below:

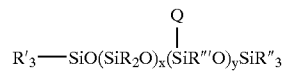

wherein R, R', R" and R'" are each, independently, H, OH, $CH_3$, ethyl or propyl, Q is a link to other blocks, and x and y are 1 or more.

Generally, X is 1–200 and y is generally 1–200. What is more, y and x may have values which provide the molecular weights and amounts of water-soluble polymer discussed below.

The water-soluble polymer resin blocks may be selected from polyethylene oxide and polypropylene oxides of the formulae $$—(CH_2)_3—(OCH_2CH_2)_z—OCH_3 \text{ and}$$

$$—(CH_2)_3—(OCH_2CH_2CH_2)_z—OCH_3,$$

wherein Z is 1 to 100.

The blocks of the water-soluble polymer preferably can comprise over 50 wt. % of the silicone block copolymer, the balance being silicone blocks. The molecular weight of the silicone block copolymer can range from about 200 to 50,000, and is preferably from 600 to 30,000. Generally, ethylene oxide blocks comprise at least 75 wt. % of the copolymer. Combinations of ethylene oxide and propylene oxide blocks can be used. The silicone block copolymers with ethylene oxide blocks may have a molecular weight in the range from 200 to 5,000 weight average molecular weight and a viscosity of 20–125 cps. The silicone block copolymers with both ethylene oxide and propylene oxide blocks can have a viscosity of 1,000–4,000 cps and molecular weight in the range of 10,000–40,000 weight average molecular weight.

The coating formulation for the back layer 230 can be prepared in conventional equipment by simply mixing deionized water, block copolymer and antifoaming agent at ambient temperature for about 30 minutes. The formulation is suitable for coating onto a substrate 240 when thoroughly mixed.

Silicone polymers soluble in organic solvents can also be used in coating formulations for the back layer 230. Suitable polar organic solvents for such polymers are esters, ketones, ethers and alcohols.

Figure 2:
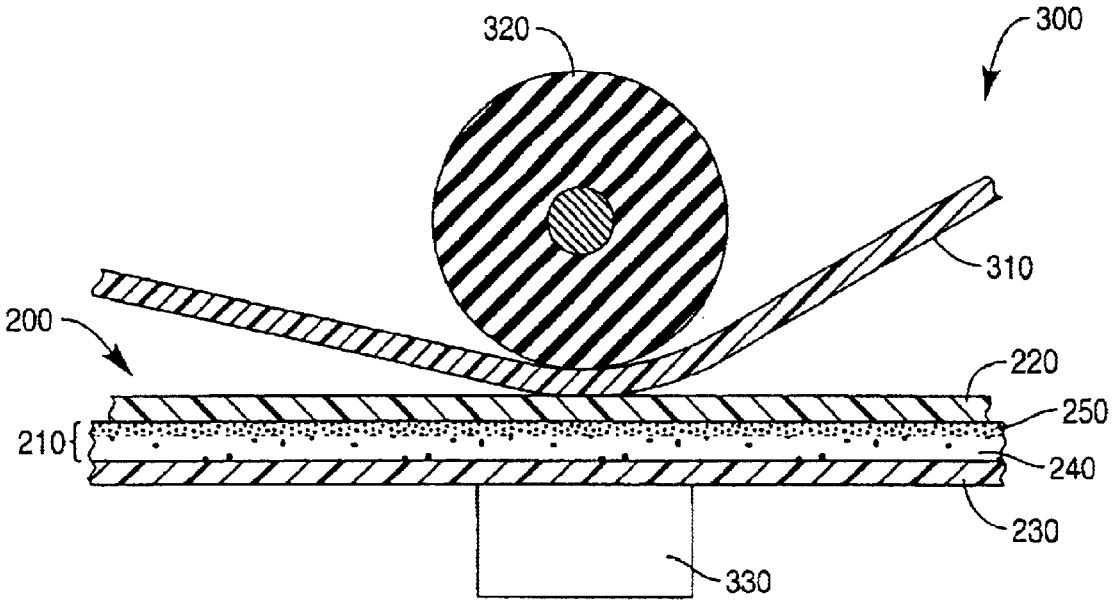
FIG. 2 schematically illustrates an exemplary thermal transfer medium of the present invention in a printing operation.

An exemplary process using the thermal transfer medium 200 of the present invention is depicted schematically in FIG. 2. The process includes a printer 300 having a roller 320 and a thermal print head 330. A receiving substrate or an article, such as a label 310, and the thermal transfer medium, such as a thermal ribbon 200, is positioned between the roller 320 and print head 330. Desirably, the label 310 is positioned proximate to the roller 320 and the ribbon 200 is positioned between the label 310 and the print head 330.

During operation, heat applied from the thermal print head 330 releases at least a portion of the functional layer 220 from the laminate 210 of the ribbon 200 onto the label 310. The coating 250 aids the separation of the functional layer 230 from the ribbon 200 to the label 310. The back layer 230 protects the substrate 210 from damage by the heat from the print head 330.

Thus, the thermal transfer medium 200 may be used for printing out characters and images in, for example, word processors, facsimile machines, printers for personal computers, printers for videos, printers for bar codes, type writers, and paper copiers.

Without further elaboration, it is believed that one skilled in the art can, using the preceding description, utilize the present invention to its fullest extent.

The entire disclosures of all applications, patents and publications, including U.S. application Ser. Nos. 09/102,326 and 09/107,139, cited above, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermal transfer medium which transfers images to a receiving substrate, the thermal transfer medium comprising:

a laminate further comprising;

a substrate;

a first coating, which is free of particulate material, positioned substantially on at least one surface of the substrate said first coating having protrusions with a length/width ratio of not less than about 3 and at a density of not less than about 20 protrusions/100 micrometer squared; and a functional layer positioned substantially on the first coating.

2. A thermal transfer medium according to claim 1, wherein the coating comprises an oil and a waxed-based composition wherein the oil is added in amount of 3–50 parts by weight to about 100 parts by weight of the wax-based composition.

3. A thermal transfer medium according to claim 2, wherein the oil is a vegetable oil, a fatty oil, a mineral oil, a synthetic lubricating oil, or mixtures thereof, and the waxed-based composition is a petroleum wax, a vegetable wax, a mineral wax, an animal wax, a low molecular wax, or mixtures thereof.

4. A thermal transfer medium according to claim 1, wherein the substrate of the laminate is a polyethylene terephthalate film.

5. A thermal transfer medium according to claim 1, further comprising a second coating comprising an oil, a silicon polymer, or combination thereof positioned on the surface of the substrate opposite the first coating.

6. A thermal transfer medium according to claim 1, wherein the coating comprises a silicon polymer.

7. A thermal transfer medium which transfers images to a receiving substrate, the thermal transfer medium comprising:

a laminate further comprising;

a substrate;

a first coating positioned on one surface of the substrate said first coating having protrusions with a length/width ratio of not less than about 3 and at a density of not less than about 20 protrusions/100 micrometer squared;

a second coating positioned on an opposing surface of the substrate from the first coating, wherein the second coating has protrusions with a length/width ratio of not less than about 3 and at a density of not less than about 20 protrusions/100 micrometer squared, and a functional layer positioned substantially on the first coating and a back layer positioned substantially on the second coating.

8. A thermal transfer medium which transfers images to a receiving substrate, the thermal transfer medium comprising (a) a laminate further comprising:

(i) a substrate;

(ii) a first coating positioned on one surface of the substrate; and (iii) a second coating positioned on the opposing surface of the substrate;

(b) a functional layer positioned on the first coating, and (c) a back layer positioned on the second coating wherein the first and second coatings are identical and each comprise an oil, a silicon polymer, a wax or a combination thereof.

* * * * *